US007101825B2

(12) United States Patent
Francis et al.

(10) Patent No.: US 7,101,825 B2
(45) Date of Patent: Sep. 5, 2006

(54) MULTILAYER FILM

(75) Inventors: John Francis, Cleveland (GB); Andrew Nathan Hodgson, Cleveland (GB)

(73) Assignee: DuPont Teijim Films U.S. Limited Partnership, Wilmington, DE (US)

( * ) Notice: Subject to any disclaimer, the term of this patent is extended or adjusted under 35 U.S.C. 154(b) by 5 days.

(21) Appl. No.: 10/473,704

(22) PCT Filed: Apr. 2, 2002

(86) PCT No.: PCT/GB02/01521

§ 371 (c)(1),
(2), (4) Date: Feb. 24, 2004

(87) PCT Pub. No.: WO02/081227

PCT Pub. Date: Oct. 17, 2002

(65) Prior Publication Data

US 2004/0147398 A1 Jul. 29, 2004

(30) Foreign Application Priority Data

Apr. 2, 2001 (GB) ..... 0108199.1

(51) Int. Cl.
*B41M 5/035* (2006.01)
*B41M 5/38* (2006.01)

(52) U.S. Cl. ..... 503/227; 428/32.39; 428/32.81

(58) Field of Classification Search ..... 428/32.5, 428/32.39, 32.81; 503/227
See application file for complete search history.

(56) References Cited

U.S. PATENT DOCUMENTS

| | | | | |
|---|---|---|---|---|
| 5,082,824 | A * | 1/1992 | Rhoades et al. | 503/227 |
| 5,135,905 | A * | 8/1992 | Egashira et al. | 503/227 |
| 5,589,324 | A | 12/1996 | Wexler | |
| 6,326,055 | B1 * | 12/2001 | Arai et al. | 427/195 |

FOREIGN PATENT DOCUMENTS

| | | |
|---|---|---|
| EP | 0 656264 | 7/1995 |
| EP | 0 807 533 A | 11/1997 |
| GB | 1003909 | 9/1965 |

* cited by examiner

*Primary Examiner*—Bruce H. Hess
(74) *Attorney, Agent, or Firm*—RatnerPrestia

(57) ABSTRACT

A thermal transfer printing receiver sheet for use in association with a compatible donor sheet, the receiver sheet comprising a receiving layer to receive a dye thermally transferred from the associated compatible donor sheet, and further comprising a release medium and adhesion-promoting medium and an antistatic medium, wherein said release medium, said adhesion-promoting medium and said antistatic medium are, independently, present as a coating on at least part of at least one surface of the receiving layer or present in the receiving layer; use thereof as a clear printable overlaminate; and a laminated multilayer film comprising one or more of said receiver sheet(s) and a backing sheet comprising a film-forming material.

21 Claims, 3 Drawing Sheets

MULTILAYER FILM

Figure 1:
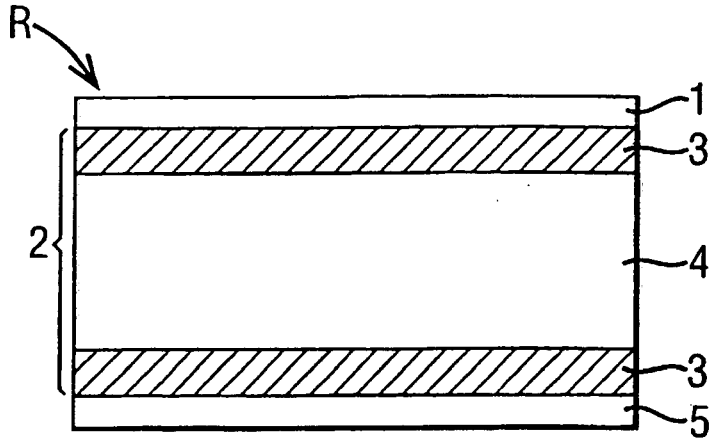

This invention relates to a receiver sheet, particularly one which is printable by thermal transfer printing. The receiver sheet is clear and is primarily intended for use as an over-laminate or overlay on a substrate or backing sheet, particularly a substrate or backing sheet which carries an image or printed information. The overlay may be printed, using an associated donor sheet, by a thermal transfer printing process, thereby enabling additional information or data to be carried by a multilayer article comprising the backing sheet and overlay. Such overlays may be referred to as clear printable or personalisable overlays or overlaminates. The invention additionally relates to a process for the production of such receiver sheets or overlays; to a process for the production of a multilayer article comprising such an overlay and backing sheet; and to the multilayer article comprising such an overlay and backing sheet.

Currently available thermal transfer printing (TTP) techniques generally involve the generation of an image on a receiver sheet by thermal transfer of an imaging medium from an associated donor sheet. The receiver sheet typically comprises a supporting substrate of paper, synthetic paper or a polymeric film material having on a surface thereof a dye-receptive, polymeric receiving layer. The associated donor sheet usually comprises a supporting substrate, of a similar material, coated with a transfer layer comprising a sublimable dye incorporated in an ink medium usually comprising a wax and/or a polymeric resin binder. When an assembly, comprising a donor and a receiver sheet positioned with the respective transfer and receiving layers in contact, is selectively heated in a patterned area derived, for example from an information signal such as a television signal, dye is transferred from the donor sheet to the dye-receptive layer of the receiver sheet to form therein a monochrome image of the specified pattern. By repeating the process with different monochrome dyes, a full coloured image is produced on the receiver sheet.

At the printing or transfer stage in a typical TTP operation both the transfer layer and the receiving layer are likely to be in a molten state, and there is a tendency for the donor sheet to become thermally bonded to the receiver sheet. Such bonding may induce wrinkling or even rupture of the donor sheet when separation thereof from the imaged receiver sheet is attempted. In certain circumstances, total transfer of the dye-containing transfer layer to the receiver sheet may occur, so that the donor sheet is effectively destroyed and portions thereof become firmly adhered to the processed receiver sheet. This behaviour is clearly undesirable. To facilitate separation of the imaged sheet from the heated assembly, at least one of the transfer layer and receiving layer may be associated with a release medium, such as a silicone oil.

The release medium is required to promote relative movement between the donor sheet and the receiver sheet to permit easy separation of one from the other. However, advancement of the donor sheet, relative to the print-head, in register with the receiver sheet usually depends upon frictional engagement between the donor sheet and the receiver sheet, the latter being mounted on a forwardly displaceable roll or platen. Inadequate bonding between the respective sheets tends to result in loss of registration, and the generation of a poorly defined image. The release medium must therefore also promote frictional bonding between the donor and receiver sheets, and is thus required to satisfy two apparently conflicting criteria.

The commercial success of a TTP system depends, inter alia, on the development of an image having adequate intensity, contrast and definition. Optical density of the image is therefore an important criterion, but unfortunately, the presence of a release medium may inhibit migration of the dye into the receiving layer, thereby reducing the optical density of the resultant image. The problem of inadequate optical density is particularly acute if the release medium is modified in any way such that it constitutes a barrier to migration of dye from the donor to the receiver sheet. This may occur, for example, when the release medium is substantially cross-linked. Likewise, inclusion in the release medium of extraneous materials may also inhibit dye migration and the presence of such extraneous materials is therefore generally undesirable.

Although the intense, localised heating required to effect development of a sharp image may be applied by various techniques, including laser beam imaging, a convenient and widely employed technique of thermal printing involves a thermal print-head, for example of the dot matrix variety in which each dot is represented by an independent heating element (electronically controlled, if desired). A problem associated with such a contact print-head is the deformation of the receiver sheet resulting from pressure of the respective elements on the heated, softened assembly. This deformation manifests itself as a reduction in the surface gloss of the receiver sheet, and is particularly significant in receiver sheets the surface of which is initially smooth and glossy, i.e. of the kind which is in demand in the production of high quality art-work.

As hereinbefore described, problems associated with commercially available TTP receiver sheets include inadequate intensity and contrast of the developed image, reduction in gloss of the imaged sheet, strike-through of the image to the rear surface of the sheet, and difficulty in maintaining register during the printing cycle. In addition, difficulties have been experienced in smoothly feeding receiver sheets to a print-head.

Various receiver sheets have been proposed for use in TTP processes. For example, EP-A-0133012 discloses a heat transferable sheet having a substrate and an image-receiving layer thereon, a dye-permeable releasing agent, such as silicone oil, being present either in the image-receiving layer or as a release layer on at least part of the image-receiving layer. Materials identified for use in the substrate include condenser paper, glassine paper, parchment paper, or a flexible thin sheet of a paper or plastics film (including polyethylene terephthalate film) having a high degree of sizing. The thickness of the substrate is ordinarily of the order of 3 to 50 μm. The image-receiving layer may be used on a resin having an ester, urethane, amide, urea, or highly polar linkage.

Related European patent application EP-A-0133011 discloses a heat transferable sheet based on substrate and imaging layer materials similar to those disclosed in EP-A-0133012 except that the exposed surface of the image-receiving layer comprises first and second regions respectively comprising (a) a synthetic resin having a glass transition temperature of from −100 to 20° C. and having a polar group, and (b) a synthetic resin having a glass transition temperature of 40° C. or above. The image-receiving layer may have a thickness of from 3 to 50 μm when used in conjunction with a substrate layer, or from 60 to 200 μm when used without a substrate layer.

EP-A-0349141 discloses a TTP receiver sheet having a release medium comprising a dye-permeable polyurethane resin which is obtainable by reacting (i) an organic polyisocyanate, (ii) an isocyanate-reactive polydialkylsiloxane, and (iii) a polymeric polyol.

EP-A-0349152 discloses a TTP receiver sheet comprising a substrate and a dye-receptive receiving layer, and having an optional dye-permeable release medium, for example an organopolysiloxane resin, on a surface of the receiving layer, and an anti-static layer, said anti-static layer being preferably on the surface of the substrate remote from the receiving layer.

The use of a receiver sheet as an overlay onto a printed substrate or backing sheet means that the receiver sheet should also be optically clear and exhibit good adhesion to the backing sheet or substrate to which it is to be laminated.

It is desirable to be able to apply additional layers or features to the surface of the receiver sheet, before or after (generally after) lamination to the backing sheet and/or before or after (generally after) thermal transfer printing. The receiver sheet should preferably also therefore exhibit good adhesion to any subsequently applied layers.

Furthermore, it is important that the receiver sheet can be processed to produce cards in standard card production processes comprising a hot press. The structure of the film must be such that the laminate so produced is of a high quality and free of surface defects which can cause handling and processing problems in themselves and also lead to subsequent defects in the printed image.

It would also be desirable to confer the above-noted combination of properties onto a receiver sheet in the most cost-effective and efficient manner.

It is an object of the invention to provide a thermal transfer printing receiver sheet, suitable for use as a personalisable overlay, which is optically clear and which exhibits good adhesive properties. The receiver sheet should also exhibit good intensity and contrast of the developed image; good gloss of the imaged sheet; substantially no strike-through of the image to the rear surface of the sheet; maintenance of the register during the printing cycle while allowing clean separation of the receiver sheet from the associated donor sheet; and smooth feeding to the print head during the TTP process. It is a further object to provide such a TTP receiver sheet which has good subsequent processability (particularly in card production processes) and which has few surface defects. It is a further object to provide such TTP receiver sheets in the most economical and efficient manner.

Accordingly, in a first aspect the present invention provides a thermal transfer printing receiver sheet for use in association with a compatible donor sheet, the receiver sheet comprising a receiving layer to receive a dye thermally transferred from the associated compatible donor sheet, and further comprising a release medium, an adhesion-promoting medium and an antistatic medium, wherein said release medium, said adhesion-promoting medium and said anti-static medium are, independently, present as a coating on at least part of at least one surface of the receiving layer or present in the receiving layer.

In a second aspect, the invention provides a method of producing a thermal transfer printing receiver sheet for use in association with a compatible donor sheet, comprising forming a receiving layer to receive a dye thermally transferred from the associated compatible donor sheet, and providing either in said receiving layer or on at least part of at least one surface of said receiving layer, a release medium, an adhesion-promoting medium and an antistatic medium.

Preferably, said release medium, said adhesion-promoting medium and said anti-static medium are, independently, present as a coating on at least part of at least one surface of the receiving layer.

The receiver sheet should be optically clear. The clarity is determined by measuring the total luminance transmission and/or the haze (% of scattered transmitted visible light) through the total thickness of the receiver sheet. Total luminance transmission in the range 80 to 100, and particularly from 88 to 95, and haze in the range <3.5%, and particularly <2.5%, is preferred.

The receiver sheet should exhibit good adhesion to the backing sheet to which it is to be laminated. A delamination strength of at least 5.0 N/cm, preferably at least 6.0 N/cm is preferred.

As used herein, the "first surface" of the receiver sheet refers to the surface of the receiver sheet onto which an image is generated by thermal transfer printing and which will be contacted by the associated donor sheet during the TTP process. The "second surface" of the receiver sheet, in the context of the primary intended use as an overlay on a backing sheet, refers to the surface of the receiver sheet which is contacted by the backing sheet in the manufacture of a multilayer article as described herein.

Preferably, said receiver sheet comprises said release medium on its first surface. Preferably said receiver sheet comprises said anti-static medium on its first surface.

In one embodiment, the receiver sheet comprises the release medium and the anti-static medium on its first surface.

In a further embodiment, the receiver sheet comprises a release medium, an anti-static medium and an adhesion-promoting medium on its first surface.

In a further embodiment, the receiver sheet comprises a release medium and an anti-static medium on its first surface and an adhesion-promoting medium on its second surface.

In a preferred embodiment, the receiver sheet comprises a release medium, an anti-static medium and an adhesion-promoting medium on its first surface, and an adhesion-promoting medium on its second surface.

In the context of the invention the following terms are to be understood as having the meanings hereto assigned:

Sheet:

includes not only a single, individual sheet, but also a continuous web or ribbon-like structure capable of being sub-divided into a plurality of individual sheets.

Compatible:

in relation to a donor sheet, indicates that the donor sheet is impregnated with a dyestuff which is capable of migrating, under the influence of heat, into, and forming an image in, the receiving layer of a receiver sheet placed in contact therewith.

Film:

is a self-supporting structure capable of independent existence in the absence of a supporting base.

Antistatic:

means that a receiver sheet incorporating an antistatic medium exhibits a reduced tendency, relative to a receiver sheet not incorporating an antistatic medium, to accumulate static electricity.

Adhesion:

means that a receiver sheet incorporating an adhesion-promoting medium increases the surface energy, relative to a receiver sheet not incorporating an adhesion-promoting medium, allowing inks and dyes etc. to be adhered.

The Receiving Layer

The receiving layer should exhibit (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria may be formed from a synthetic thermoplastics polymer. The morphology of the receiving layer may be varied depending on the required characteristics. For example, the polymer of the receiving layer may be of an essentially amorphous nature to enhance optical density of the transferred image, essentially crystalline to reduce surface deformation, or partially amorphous/crystalline to provide an appropriate balance of characteristics.

A dye-receptive polymer for use in the receiving layer suitably comprises a polyester resin, particularly a copolyester resin, derived from one or more dibasic aromatic carboxylic acids, such as terephthalic acid, isophthalic acid and hexahydroterephthalic acid, and one or more glycols, particularly an aliphatic glycol, such as ethylene glycol, diethylene glycol, triethylene glycol and neopentyl glycol. Typical copolyesters which provide satisfactory dye-receptivity and deformation resistance are those of ethylene terephthalate and ethylene isophthalate, especially in the molar ratios of from 50 to 90 mole % ethylene terephthalate and correspondingly from 50 to 10 mole % ethylene isophthalate. Preferred copolyesters comprise from 65 to 85 mole % ethylene terephthalate and from 35 to 15 mole % ethylene isophthalate, and especially a copolyester of about 82 mole % ethylene terephthalate and about 18 mole % ethylene isophthalate.

The receiving layer according to the invention may be uniaxially oriented, but is preferably biaxially oriented by drawing in two mutually perpendicular directions in the plane of the film to achieve a satisfactory combination of mechanical and physical properties. Formation of the film may be effected by any process known in the art for producing an oriented polymeric film, for example a tubular or flat film process.

In a tubular process simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process, a film-forming polymer is extruded through a slot die and rapidly quenched upon a chilled casting drum to ensure that the polymer is quenched to the amorphous state.

Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, ie the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer. For example, a polyester is usually stretched so that the dimension of the oriented polyester film is from 2.5 to 4.5 its original dimension in the, or each, direction of stretching. Stretching is typically effected at a temperature in the range 70 to 125° C.

A stretched film may be, and preferably is, dimensionally stabilised by heat-setting under dimensional restraint at a temperature above the glass transition temperature of the film-forming polymer but below the melting temperature thereof, to induce crystallization of the polymer. Heat-setting is typically effected at a temperature in the range of 150 to 250° C., as described in GB-A-838708.

Polymers which exhibit a high receptivity to dye thermally transferred from a donor sheet, and which are therefore suitable for use in TTP receiver sheets, generally require an additional layer to provide the requisite mechanical properties of the receiving sheet. In a preferred embodiment, the receiving layer comprises a multilayer structure comprising a dye-receptive layer and a substrate layer. The dye-receptive layer may comprise any of the dye-receptive polymers described above. The substrate may be formed from any synthetic, film-forming polymeric material. Suitable thermoplastics, synthetic, materials include a homopolymer or a copolymer of a 1-olefin, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, eg terephthalic acid, isophthalic acid, phthalic acid, 2,5-, 2,6- or 2,7-naphthalenedicarboxylic acid, succinic acid, sebacic acid, adipic acid, azelaic acid, 4,4-diphenyldicarboxylic acid, hexahydro-terephthalic acid or 1,2-bis-p-carboxyphenoxyethane (optionally with a monocarboxylic acid, such as pivalic acid) with one or more glycols, eg ethylene glycol, 1,3-propanediol, 1,4-butanediol, neopentyl glycol and 1,4 cyclohexanedimethanol. The substrate layer preferably comprises polyethylene terephthalate.

In a preferred embodiment, the receiving layer comprises an ABA multilayer structure comprising a substrate layer as described above, disposed between first and second dye-receptive layers as described above. Preferably, the substrate layer comprises polyethylene terephthalate, and the first and second dye-receptive layers comprise a copolyester of from 65 to 85 mole % ethylene terephthalate and from 35 to 15 mole % ethylene isophthalate, and especially a copolyester of about 82 mole % ethylene terephthalate and about 18 mole % ethylene isophthalate. Such dye-receptive layers exhibit good adhesion to the substrate of a multilayer receiving layer.

The thickness of the substrate of a multilayer structure may vary but, in general, will not exceed 350 μm, and will preferably be in a range from 40 to 250 μm, more preferably from 50 to 100 μm. The thickness of the dye-receptive layer(s) of a multilayer structure may vary over a wide range but generally will not exceed 100 μm. The dry thickness of the dye-receptive layer governs, inter alia, the optical density of the resultant image developed in a particular receiving polymer, and preferably is within a range of from 0.5 to 25 μm. It has been observed that by careful control of the dye-receptive layer thickness to within a range of from 0.5 to 15 μm, particularly 0.5 to 10 μm, in association with a substrate layer as described herein, a significant improvement in resistance to surface deformation is achieved, without significantly detracting from the optical density of the transferred image.

In one embodiment, the total thickness of the receiving layer is in the range of from 50 to 100 μm.

A multilayer receiving layer of the kind hereinbefore described offers numerous advantages including (1) a degree of clarity and brightness essential in the production of prints having the intensity, contrast and feel of high quality artwork, (2) a degree of rigidity and stiffness contributing to improved resistance to surface deformation and image strike-through associated with contact with the print-head, and (3) a degree of stability, both thermal and chemical, conferring dimensional stability and curl-resistance.

In addition, the preferred multilayer ABA receiver sheet of the kind hereinbefore described, when used as an overlay on a backing sheet for the production of a mutltilayer article (such as a card) as described herein, exhibits surprisingly increased adhesion to the backing sheet.

The receiving layer or, where the receiving layer is a multilayer structure, one or more of the layers of the receiving layer (i.e. the dye-receptive layer(s) and/or the substrate layer as described above), may conveniently contain any of the additives conventionally employed in the manufacture of polymeric films. Such additives are generally present only in relatively small quantities. Thus, agents such as cross-linking agents, dyes, pigments, voiding agents, lubricants, anti-oxidants, radical scavengers, UV absorbers, thermal stabilisers, anti-blocking agents, surface active agents, slip aids, optical brighteners, gloss improvers, prodegradents, viscosity modifiers and dispersion stabilisers may be incorporated as appropriate.

For example, a layer may comprise a particulate filler, such as a particulate inorganic filler or an incompatible resin filler or a mixture of two or more such fillers, preferably a particulate inorganic filler. Preferred particulate inorganic fillers include titanium dioxide and silica. In order to achieve the requisite clarity, filler is typically present in only small amounts, generally not exceeding 0.5% and preferably less than 0.2% by weight of the layer. Fillers of this type are well-known in the art and are described, for instance, in WO-A-98-06575 the disclosure of which is incorporated herein by reference.

In addition, the presence of one or more UV absorbers is particularly preferred in order to impede the onset of ageing. Suitable UV absorbers include those described in WO-A-98-06575 the disclosure of which is incorporated herein by reference. UV absorbers may be present, for example, in amounts up to about 20000 parts per million. The UV absorber may also be present as a copolymerised residue in the chain of the film-forming polymer. In particular, when the polymer of the receiving layer is a polyester, the polyester chain conveniently comprises a copolymerised esterification residue of an aromatic carbonyl UV stabilising compound. Suitable esterification residues include the residue of a di(hydroxyalkoxy)coumarin, as described in EP-A-0031202; the residue of a 2-hydroxy-di(hydroxyalkoxy) benzophenone, as described in EP-A-0031203; the residue of a bis(hydroxyalkoxy)-xanth-9-one, as described in EP-A-006686; and the residue of a hydroxy-bis(hydroxyalkoxy)-xanth-9-one, as described in EP-A-0076582, the disclosures of which European Patent Applications are incorporated herein by reference. A particularly preferred residue is derived from 1-hydroxy-3,6-bis(hydroxyalkoxy)xanth-9-one. The alkoxy groups in the aforementioned UV stabilising compounds conveniently contain from 1 to 10 and preferably from 2 to 4 carbon atoms, for example an ethoxy group. The content of the esterification residue is conveniently from 0.01 to 30%, and preferably from 0.05 to 10%, by weight of the total weight of the polymer of the receiving layer.

The optical characteristics and processing behaviour of a receiver sheet according to the invention may be improved by incorporating a minor amount of a suitable modifying agent, for instance a salt comprising a cation selected from the elements of Groups I-A, II-A, III-A and IV-B of the Periodic Table of the Elements. Typical such modifiers include salts such as the hydroxides and halides, especially chlorides, of sodium, calcium, aluminium and zirconium.

The components of the composition of a layer may be mixed together in a conventional manner. For example, by mixing with the monomeric reactants from which the layer polymer is derived, or the components may be mixed with the polymer by tumble or dry blending or by compounding in an extruder, followed by cooling and, usually, comminution into granules or chips. Masterbatching technology may also be employed.

Formation of a multilayer receiving layer may be effected by conventional techniques, for example by casting the dye-receptive polymer onto a preformed substrate layer. Conveniently, however, formation of a composite sheet (substrate and dye-receptive layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A coextruded sheet is stretched to effect molecular orientation of the substrate, and preferably heat-set, as hereinbefore described. Generally, the conditions applied for stretching the substrate layer will induce partial crystallisation of the dye-receptive polymer and it is therefore preferred to heat set under dimensional restraint at a temperature selected to develop the desired morphology of the dye-receptive layer. Thus, by effecting heat-setting at a temperature below the crystalline melting temperature of the dye-receptive polymer and permitting or causing the composite to cool, the dye-receptive polymer will remain essentially crystalline. However, by heat-setting at a temperature greater than the crystalline melting temperature of the dye-receptive polymer, the latter will be rendered essentially amorphous. Heat-setting of a receiving layer comprising a polyester substrate and a copolyester dye-receptive layer is conveniently effected at a temperature within a range of from 175 to 200° C. to yield a substantially crystalline dye-receptive layer, or from 200 to 250° C. to yield an essentially amorphous dye-receptive layer.

The Anti-Static Medium

The antistatic medium for use in the present invention may be any such medium known in the art for its anti-static properties. Such antistatic media are disclosed in, for example, U.S. Pat. No. 5,589,324, U.S. Pat. No. 4,225,665, EP-A-0036702, EP-A-0027699, EP-A-0190499 and EP-A-0678546 and the documents referenced therein, the disclosures of which are incorporated herein by reference. The antistatic medium may be anionic, neutral or cationic, but is preferably anionic or neutral. Particularly preferred antistatic media comprise homopolymer(s) and/or copolymer(s) of sodium styrenesulphonate, particularly those disclosed in U.S. Pat. No. 5,589,324 incorporated herein by reference. Preferably, the anti-static medium comprises a copolymer of (a) the sodium salt of a styrene sulphonic acid and (b) maleic anhydride, i.e. poly(sodium styrene sulphonate-maleic anhydride).

Desirably, the alkali metal content of the poly(sodium styrene sulphonate-maleic anhydride) should not exceed 1.0%, preferably 0.75%, and particularly preferably 0.50%, of the combined weight of components (a) and (b). The relative proportions of the respective components of the poly(sodium styrene sulphonate-maleic anhydride) may vary within a wide range, and desirably should be selected by simple experimentation to provide an antistatic layer which confers upon the receiver sheet a surface resistivity not exceeding 12.5, and preferably less than 12.0 logohms/square at 50% relative humidity and 23° C. Desirably, components (a) and (b) are present in a weight ratio of from about 0.5:1 to 5:1.

After the antistatic coating has been dried, an undesirable powdery surface "bloom" may develop. This powdery surface bloom not only impairs the optical clarity of the receiver sheet, but may also be wiped off during, and in a manner which interferes with, subsequent processing of the receiver sheet. To avoid this undesirable powdery surface bloom, the alkali metal content of the antistatic medium should be maintained at the specified level.

The antistatic medium may be incorporated into the receiving layer, in which case the antistatic medium is mixed with the film-forming polymer of the receiving layer prior to extrusion in accordance with conventional techniques well-known in the art. Preferably, however, the antistatic medium is applied as a coating to one or both surfaces of the receiving layer using conventional techniques, described in more detail below. The concentration of the antistatic medium in the liquid coating composition depends, inter alia, on the level of antistatic properties required in the receiver sheet, and on the wet thickness of the applied coating layer, but an effective concentration is conveniently from about 0.5 to about 10%, preferably from 1 to 5% (weight/volume). The dried coating conveniently exhibits a dry coat weight of from about 0.1 to about 1.0 mg/dm$^{-2}$. The thickness of an antistatic layer is therefore generally within a range of from 0.01 to 0.1 μm.

The use of an anti-static medium is effective in reducing or substantially eliminating contamination of the surface by airborne dust. In addition, the anti-static media preferred for use in the present invention are particularly advantageous since they allow enhanced efficiency and ease of coating when coated simultaneously with the release medium and/or the adhesion-promoting medium, particularly the preferred release medium and adhesion-promoting medium described below. In particular, the preferred anti-static media avoid the problem of coagulation of a coating medium in which the anti-static medium is simultaneously present with the release medium and/or the adhesion-promoting medium, thereby improving the efficiency and economy of the manufacture of the receiving sheet.

The Release Medium

The receiver sheet of the present invention may comprise the release medium either within the receiving layer or, preferably, as a discrete layer on at least part of a surface of the receiving layer. The release medium may be applied to a surface of the receiving layer, preferably as an aqueous dispersion according to conventional techniques, as described in more detail below. Where the release medium is incorporated into the receiving layer, it is mixed with the film-forming polymer of the receiving layer prior to extrusion in accordance with conventional techniques well-known in the art, in an amount of up to 50% by weight of the polymer of the receiving layer.

The release medium should be permeable to the dye transferred from the donor sheet and comprises a release agent, for example of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. An organopolysiloxane resin is particularly suitable for application as a discrete layer on at least part of the exposed surface of the receiving layer.

The release medium preferably comprises a polyurethane abherent resin, particularly a polyurethane resin comprising the reaction product of (i) an organic polyisocyanate, (ii) an isocyanate-reactive polydialkylsiloxane, and (iii) a polymeric polyol. Suitable release media of this type are disclosed in, for example, EP-A-0349141, the disclosure of which is incorporated herein by reference.

The organic polyisocyanate component of the polyurethane release medium may be an aliphatic, cycloaliphatic, araliphatic or aromatic polyisocyanate. Examples of suitable polyisocyanates include ethylene diisocyanate, 1,6-hexamethylene diisocyanate, isophorone diisocyanate, cyclohexane-1,4-diisocyanate, 4-4'-dicyclohexylmethane diisocyanate, p-xylylene diisocyanate, 1,4-phenylene diisocyanate, 2,4-toluene diisocyanate, 2,6-toluene diisocyanate, 4,4'-diphenylmethane diisocyanate, 2,4'-diphenylmethane diisocyanate, polymethylene polyphenyl polyisocyanates and 1,5-naphthylene diisocyanate. Mixtures of polyisocyanates may be used and also polyisocyanates which have been modified by the introduction of urethane, allophanate, urea, biuret, carbodiimide, uretonimine or isocyanurate residues.

The isocyanate-reactive polydialkylsiloxane may be mono-functional, but conveniently comprises at least two isocyanate-reactive groups. Polydialkylsiloxanes in which the alkyl group contains from 1 to 8 carbon atoms, particularly a methyl group, and having at least two isocyanate-reactive groups are known. These include polydimethylsiloxanes having two or more reactive groups selected from hydroxy, mercapto, primary amino, secondary amino and carboxy groups. The polydialkylsiloxane may be linear, for example a diol having a hydroxy group at each end, or it may be branched, having three or more isocyanate-reactive groups which may be situated at the various ends of the molecule or may all be located at one end. Examples of suitable polydimethylsiloxanes include diols of formula (I):

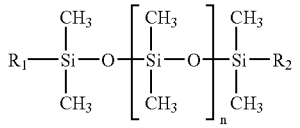

(I)

wherein:

n is an integer from 0 to 100, preferably from 1 to 50, and more preferably from 10 to 20;

$R_1$ and $R_2$, which may be the same or different, are —$(CH_2)_y(OX)_z$—OH;

X is selected from —$CH_2$—$CH_2$— and —$CH(CH_3)$—$CH_2$—;

y is an integer of from 2 to 12, preferably 2 to 4, and more preferably 3; and z is an integer of from 0 to 25, preferably 5 to 15, and more preferably 11 or 12.

Further examples of suitable polydimethylsiloxanes include triols of the formula (II):

(II)

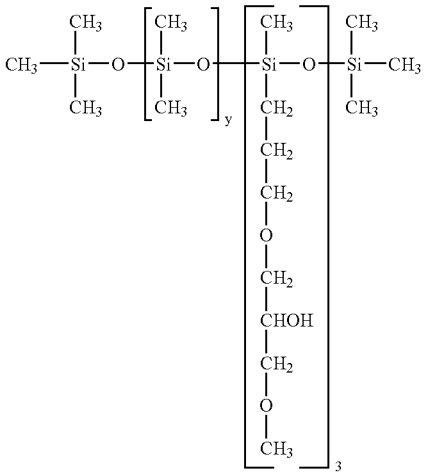

wherein y is an integer from 40 to 150, particularly from 50 to 75.

The polymeric polyol component of the release medium may be a member of any of the chemical classes of polymeric polyols suitable for use in polyurethane formulations. For example, the polymeric polyol may be a polyester, polycarbonate, polyesteramide, polyether, polythioether, polyacetal or polyolefin, preferably a polycarbonate, which has a relatively high glass transition temperature (Tg of about 140° C.) and confers desirable hardness to the release medium. Polycarbonates are essentially thermoplastics polyesters of carbonic acid with aliphatic or aromatic dihydroxy compounds and may be represented by the general formula (III):

(III)

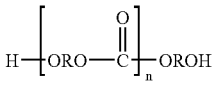

wherein R is a divalent aliphatic or aromatic radical and n is an integer of from 2 to 20. They may be prepared by conventional procedures, such as transesterification of a diester of carbonic acid with an aliphatic or aromatic dihydroxy compound or with mixed aliphatic or aromatic dihydroxy compounds. Typical reactants may comprise 2,2-(4,4'-dihydroxydiphenyl)-propane, commonly known as bisphenol A; 1,1-isopropylidene-bis-(p-phenyleneoxy-2-ethanol), commonly known as ethoxylated bisphenol A; or 1,4-cyclohexanedimethanol.

Preferably, the molecular weight of the polymeric polyol is from 700 to 3000.

The polyurethane release medium may additionally comprise one or more compounds containing a plurality of isocyanate-reactive groups. A suitable additional isocyanate-reactive compound comprises an organic polyol, particularly a short chain aliphatic diol or triol, or mixture thereof, having a molecular weight in the range 62 to 6000 and being free from silicon atoms. An organic diamine, particularly an aliphatic diamine, may also be included either independently or together with the organic polyol.

A typical release medium thus comprises a urethane-silicone polymer including a structure of formula IV:

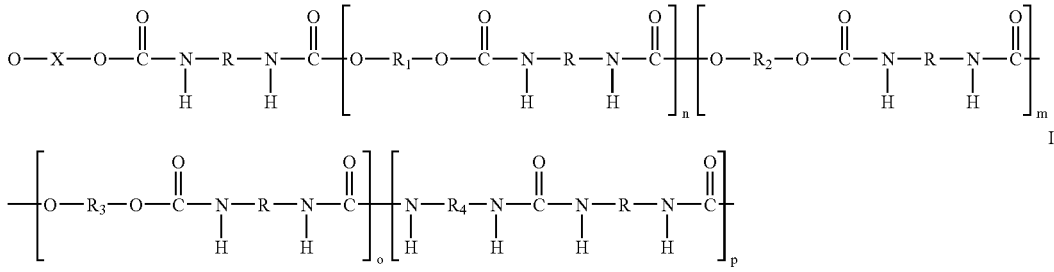

IV wherein:

R=a divalent aliphatic, cycloaliphatic or aromatic hydrocarbon radical;

X=$R_1$ or $R_2$;

$R_1$=a polycarbonate, polyester or polyether group;

$R_2$=a silicone chain of molecular weight from 500 to 3000;

$R_3$=divalent aliphatic and/or cycloaliphatic hydrocarbon radical;

$R_4$=divalent aliphatic hydrocarbon radical, optionally containing a carboxyl group, n and m are integers of from 1 to 20; and o and p are integers of from 0 to 20.

A catalyst for urethane formation, such as dibutyltin dilaurate and/or stannous octoate may be used to assist formation of the release medium, and a non-reactive solvent may be added before or after formation of the medium to control viscosity. Suitable non-reactive solvents which may be used. include acetone, methylethylketone, dimethylformamide, ethylene carbonate, propylene carbonate, diglyme, N-methylpyrrolidone, ethyl acetate, ethylene and propylene glycol diacetates, alkyl ethers of ethylene and propylene glycol monoacetates, toluene, xylene and sterically hindered alcohols such as t-butanol and diacetone alcohol. The preferred solvents are water-miscible solvents such as N-methylpyrrolidone, dimethyl sulphoxide and dialkyl ethers of glycol acetates or mixtures of N-methylpyrrolidone and methylethylketone. Other suitable solvents include vinyl monomers which are subsequently polymerised.

The polyurethane resins are water-dispersible. An aqueous polyurethane dispersion may be prepared by dispersing the polyurethane resin in an aqueous medium, preferably in the presence of an effective amount of a polyfunctional active hydrogen-containing chain extender. The resin may be dispersed in water using techniques well known in the art.

Preferably, the resin is added to the water with agitation or, alternatively, water may be stirred into the resin.

The polyfunctional active hydrogen-containing chain extender, if employed, is preferably water-soluble, and water itself may be effective. Other suitable extenders include a polyol, an amino alcohol, ammonia, a primary or secondary aliphatic, alicyclic, aromatic, aliphatic, araliphatic or heterocyclic amine, especially a diamine, hydrazine or a substituted hydrazine. Examples of suitable chain extenders include ethylene diamine, diethylene triamine, triethylene tetramine, propylene diamine, butylene diamine, hexamethylene diamine, cyclohexylene diamine, piperazine, 2-methyl piperazine, phenylene diamine, tolylene diamine, xylylene diamine, tris(2-aminoethyl)amine, 3,3-dinitrobenzidine, (4,4'-methylenebis(2-chloroaniline), 3,3'-dichloro-4,4-biphenyl diamine, 2,6-diaminopyridine, 4,4'-diaminodiphenylmethane, menthane diamine, m-xylene diamine, isophorone diamine, and adducts of diethylene triamine with acrylate or its hydrolysed products. Further suitable materials include hydrazine, azines such as acetone azine, substituted hydrazines such as dimethyl hydrazine, 1,6-hexamethylene-bis-hydrazine, carbodihydrazine, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulphonic acid dihydrazide, omega-amino-caproic acid dihydrazide, hydrazides made by reacting lactones with hydrazines such as gamma-hydroxylbutyric hydrazide, bis-semi-carbazide, bis-hydrazide carbonic esters of glycols such as any of the glycols mentioned above.

Where the chain extender is other than water, for example a diamine or hydrazine, it may be added to the aqueous dispersion of polyurethane resin or, alternatively, it may already be present in the aqueous medium when the resin is dispersed therein.

Desirably, the polyfunctional chain extender should be capable of intra-molecular cross-linking, to improve durability and resistance to solvents. Suitable resinous intra-molecular cross-linking agents comprise epoxy resins, alkyd resins and/or condensation products of an amine, e.g. melamine, diazine, urea, cyclic ethylene urea, cyclic propylene urea, thiourea, cyclic ethylene thiourea, alkyl melamines, aryl melamines, benzoguanamines, guanamines, alkyl guanamines and aryl guanamines with an aldehyde, e.g. formaldehyde. A useful condensation product is that of melamine with formaldehyde. The condensation product may optionally be partially or totally alkoxylated, the alkoxy group preferably being of low molecular weight, such as methoxy, ethoxy, n-butoxy or iso-butoxy. A hexamethoxymethyl melamine condensate is particularly suitable. Another particularly suitable cross-linking agent is a polyaziridine.

Such polyfunctional extenders preferably exhibit at least trifunctionality (i.e. three functional groups) to promote inter-molecular cross-linking with the functional groups present in the polyurethane resin and improve adhesion of the release medium to the receiving layer.

In a preferred embodiment of the invention, the release medium comprises a chain extender and a cross-linking agent.

The chain extension may be conducted at elevated, reduced or ambient temperatures. Convenient temperatures are from about 5 to 95° C. or more, preferably from about 10 to about 45° C.

The amount of chain extender employed should be approximately equivalent to the amount of free-NCO groups in the resin, the ratio of active hydrogens in the chain extender to NCO groups in the resin preferably being in the range from 1.0 to 2.0:1.

A catalyst is preferably introduced into the release medium to accelerate the intra-molecular cross-linking action of the resinous cross-linking agent and also to accelerate its inter-molecular cross-linking action with cross-linkable functional groups in the polyurethane resin. Preferred catalysts for cross-linking melamine formaldehyde include ammonium chloride, ammonium nitrate, ammonium thiocyanate, ammonium dihydrogen phosphate, diammonium hydrogen phosphate, para toluene sulphonic acid, sulphuric acid, maleic acid stabilised by reaction with a base, ammonium para toluene sulphonate and morpholinium para toluene sulphonate.

A cured release layer preferably has a dry thickness of up to about 5 μm, preferably from 0.025 to 2.0 μm.

A release medium of the kind described yields a receiver sheet having excellent optical characteristics, devoid of surface blemishes and imperfections, which is permeable to a variety of dyes, and confers multiple, sequential release characteristics whereby a receiver sheet may be successively imaged with different monochrome dyes to yield a full coloured image. In particular, register of the donor and receiver sheets is readily maintained during the thermal transfer printing operation without risk of wrinkling, rupture or other damage being sustained by the respective sheets.

The Adhesion-Promoting Medium

The adhesion-promoting medium preferably comprises an acrylic and/or methacrylic polymeric resin, such as those described in EP-A-0432886, the disclosure of which is incorporated herein by reference. Suitable polymers comprise at least one monomer derived from an ester of acrylic acid, preferably an alkyl ester where the alkyl group is a $C_{1-10}$ alkyl group such as methyl, ethyl, n-propyl, isopropyl, n-butyl, iso-butyl, ter-butyl, hexyl, 2-ethylhexyl, heptyl, and n-octyl, and more preferably ethyl or butyl. Polymers comprising alkyl acrylate monomer units and further comprising alkyl methacrylate monomer units are particularly preferred. Polymers comprising ethyl acrylate and alkyl methacrylate, particularly methyl methacrylate, are especially preferred. The alkyl acrylate monomer units are preferably present in a proportion in the range of from about 30 to about 65 mole %, and the alkyl methacrylate monomer units are preferably present in a proportion in the range of 20 to about 60 mole %.

Other monomer units which may be present in the polymeric resin of the adhesion-promoting medium include acrylonitrile, methacrylonitrile, halo-substituted acrylonitrile, halo-substituted methacrylonitrile, acrylamide, methacrylamide, N-methylol acrylamide, N-ethanol acrylamide, N-propanol acrylamide, N-methacrylamide, N-ethanol methacrylamide, N-methyl acrylamide, N-tertiary butyl acrylamide, hydroxyethyl methacrylate, glycidyl acrylate, glycidyl methacrylate, dimethylamino ethyl methacrylate, itaconic acid, itaconic anhdyride and half esters of itaconic acid. Such monomeric units may be copolymerised as optional additional monomers with the afore-mentioned esters of acrylic acid and/or methacrylic acid.

Further monomer units which may be present in the polymeric resin of the adhesion-promoting medium include vinyl esters such as vinyl acetate, vinyl chloroacetate, vinyl benzoate, vinyl pyridine, vinyl chloride, vinylidene chloride, maleic acid, maleic anhydride, styrene and derivatives of styrene such as chloro styrene, hydroxy styrene and alkylated styrenes, wherein the alkyl group is a $C_{1-10}$ alkyl group.

In a preferred embodiment, the adhesion-promoting medium comprises a polymeric resin derived from about 35 to 60 mole % of ethyl acrylate, about 30 to 55 mole % of methyl methacrylate, and about 2 to 20 mole % of acrylamide or methacrylamide, preferably methacrylamide. In a particularly preferred embodiment, the polymeric resin comprises ethyl acrylate, methyl methacrylate and acrylamide or methacrylamide (preferably methacrylamide) in the approximate molar proportions of 46/46/8 respectively.

The molecular weight of the polymeric resin of the adhesion-promoting medium can vary over a wide range but is preferably within the range 40,000 to 300,000, and more preferably within the range 50,000 to 200,000.

The adhesion-promoting medium may, and preferably does, also contain a cross-linking agent which functions to cross-link the polymer thereby improving adhesion to the receiving layer. Additionally, the cross-linking agent should preferably be capable of internal cross-linking in order to provide protection against solvent penetration. Suitable cross-linking agents include epoxy resins, alkyl resins, amine derivatives (such as hexamethoxymethyl melamine) and condensation products of an amine such as melamine, diazine, urea, cyclic ethylene urea, cyclic propylene urea, thiourea, cyclic ethylene thiourea, alkyl melamines, aryl melamines, benzo guanamines, guanamines, alkyl guanamines and aryl guanamines) with an aldehyde (such as formaldehyde). A preferred cross-linking agent is a condensation product of melamine with formaldehyde. The condensation product may optionally be alkoxylated, for example methoxylated or ethoxylated. The cross-linking agent is preferably used in amounts of up to 25% by weight based on the weight of the polymer of the adhesion-promoting medium. A catalyst is preferably employed to facilitate the cross-linking action of the cross-linking agent. Preferred catalysts wherein the cross-linker comprises melamine formaldehyde include ammonium chloride, ammonium nitrate, ammonium thiocyanate, ammonium dihydrogen phosphate, ammonium sulphate, diammonium hydrogen phosphate, para-toluene sulphonic acid, maleic acid stabilised by reaction with a base, and morpholinium paratoluene sulphonate.

The adhesion-promoting medium may, and preferably does, also comprise one or more phthalate ester(s) to improve the adhesion to subsequently applied layers. The use of a phthalate ester is particularly advantageous in the adhesion-promoting medium applied to the second surface of the receiver sheet in order to increase the delamination strength of the receiver sheet to the backing sheet in a laminated multilayer card. The phthalate ester is present in an amount effective to improve the adhesion of the receiver sheet to the backing sheet, preferably in an amount in the range of from about 0.01 to 10%, preferably about 0.01 to 5.0%, and more preferably about 0.01 to 2.0% by weight relative to the total weight of solids in the adhesion-promoting layer on the second surface of the receiver sheet. Suitable phthalate esters are generically and specifically disclosed in EP-A-0576169, the disclosure of which is incorporated herein by reference, and include dimethyl phthalate, diethyl phthalate, dibutyl phthalate, diisohexyl phthalate, butyl 2-ethylhexyl phthalate, di-2-ethylhexyl phthalate, diisooctyl phthalate, dicapryl phthalate, heptyl nonyl phthalate, diisononyl phthalate, butyl isodecyl phthalate, n-octyl n-decyl phthalate, diisodecyl phthalate, heptyl nonyl undecyl phthalate, diundecyl phthalate, ditridecyl phthalate, diallyl phthalate, butyl cyclohexyl phthalate, dicyclohexyl phthalate, diphenyl phthalate, butyl benzyl phthalate, cyclohexyl benzyl phthalate, 7-(2,6,6,8-tetramethyl-4-oxa-3-oxo-nonyl)benzyl phthalate, methoxyethoxyethyl benzyl phthalate, dimethoxyethyl phthalate, diethoxyethoxyethyl phthalate and dibutoxyethyl phthalate. A particularly preferred phthalate ester is benzyl 2-ethylhexyl phthalate. In order to optimise the compatability of the phthalate ester with the acrylic resin it is preferred that the phthalate ester has a dielectric constant in the range from 3.0 to 8.0, more preferably from 4.5 to 7.5, and particularly from 5.0 to 6.5. The molecular weight of the phthalate ester is preferably less than 5000, more preferably less than 1000, particularly in the range from 200 to 600, and especially from 300 to 400.

The adhesion-promoting medium is preferably applied to at least part of a surface of the receiving layer using conventional techniques as described in more detail below. The polymer of the adhesion-promoting medium is generally water-insoluble. The polymer of the adhesion-promoting medium may nevertheless be applied to a surface of the receiving layer as an aqueous dispersion or alternatively as a solution in an organic solvent. The adhesion-promoting medium is preferably applied as an aqueous dispersion.

The adhesion-promoting medium is preferably applied to the receiving layer at a coat weight within the range 0.1 to 10 mg/dm$^2$, especially 0.1 to 2.0 mg/dm$^2$, in order to produce a continuous coating. Provision of such a coating can improve the slip properties of the receiver sheet, i.e. its windability, as well as improving the adhesion of a range of subsequently applied coatings, inks and lacquers. It is also possible to produce a discontinuous coating layer, in which case the polymeric resin is applied at a coat weight within the range 0.01 to 0.2 mg/dm$^2$, especially 0.03 to 0.1 mg/dm$^2$. However, a continuous coating is preferred to provide the optimum combination of good slip properties and good adhesion Modification of the surface of the coated receiving layer, e.g. by flame treatment, ion bombardment, electron beam treatment, ultra-violet light treatment or preferably by corona discharge, may improve the adhesion of subsequently applied inks and lacquers, but may not be essential to the provision of satisfactory adhesion.

The preferred treatment by corona discharge may be effected in air at atmospheric pressure with conventional equipment using a high frequency, high voltage generator, preferably having a power output of from 1 to 20 kW at a potential of 1 to 100 kV. Discharge is conveniently accomplished by passing the film over a dielectric support roller at the discharge station at a linear speed preferably of 1.0 to 500 m per minute. The discharge electrodes may be positioned 0.1 to 10.0 mm from the moving film surface.

The release medium, the anti-static medium and the adhesion-promoting medium may be applied as a coating composition to a surface of the receiving layer according to conventional techniques. It is preferred, particularly in the case of a polyester-containing receiving layer the formation of which involves relatively high extrusion and/or treatment temperatures, to deposit the various media directly onto the surface of the receiving layer from a solution or dispersion in a suitable volatile medium. Preferably, for economy and ease of application, the volatile medium is an aqueous medium, particularly an aqueous dispersion. However, solutions in water or volatile organic solvent may also be used. A coating composition may be applied to the polymeric film by any suitable conventional coating technique such as dip coating, bead coating, reverse roller coating or slot coating.

In the preceding discussion, the application of the release medium, the antistatic medium and the adhesion-promoting medium to a surface of the receiving layer has been described separately. The application of any combination of the three media to the receiving layer may be achieved sequentially or simultaneously in the same coating step. Preferably all three components are applied in the same coating step, preferably at a coat weight within the range 0.1 to 10 mg/dm$^2$, more preferably 0.1 to 2.0 mg/dm$^2$, and particularly 0.1 to 0.5 mg/dm$^2$. In a preferred embodiment, a combined coating composition comprises the release medium at a concentration in the range of about 0.5 to about 6%, preferably about 0.5 to about 3% by weight; the anti-static medium at a concentration in the range of about 0.05 to about 2.0%, preferably about 0.1 to about 1.0% by weight of the composition; and the adhesion-promoting medium at a concentration in the range of about 1 to about 6%, preferably about 1 to about 4% by weight, relative to the total weight of the dry solids in the coating composition. Where the adhesion-promoting medium is coated onto the second surface of the receiver sheet, the preferred concentration is in the range of about 1 to about 6%, preferably about 2 to about 4% by weight, relative to the total weight of dry solids in the coating composition.

Application of each of the various media to a surface of the receiving layer may be effected at any convenient stage in the production of the receiver sheet. For instance, the coating composition(s) may be applied to an already-oriented receiving layer. However, application of the coating composition(s) is preferably effected before or during the stretching operation. In particular, it is preferred that a coating composition is applied to the receiving layer between the two stages (longitudinal and transverse) of a biaxial stretching operation. Such a sequence of stretching and coating is especially preferred for the production of a linear polyester-based receiving layer, which is preferably firstly stretched in the longitudinal direction over a series of rotating rollers, coated, and then stretched transversely in a stenter oven, preferably followed by heat setting.

The temperatures applied to the coated film during the subsequent stretching and/or heat-setting are effective in removing the aqueous medium, or the volatile organic solvent, of the coating composition(s). Such temperatures also assist in coalescing and forming the coating into a continuous and uniform layer. In addition, such temperatures may also effect the cross-linking of the anti-static components and cross-linking of the release medium components.

Where a coating composition is applied to a receiving layer which has already been oriented and heat-set, an additional drying step is used to remove the volatile medium and effect cross-linking of any cross-linkable components. Drying may be effected by conventional techniques, for example by passing the coated film substrate through a hot air oven, for example at temperatures of from 100 to 160° C., preferably from 100 to 120° C.

The coating layer(s) comprising the release medium and/or the antistatic medium and/or the adhesion-promoting medium may conveniently contain any of the additives conventionally employed in the manufacture of polymeric films. Thus, agents such as dyes, pigments, voiding agents, lubricants, anti-oxidants, anti-blocking agents, surface active agents, slip aids, gloss-improvers, prodegradants, ultra-violet stabilisers, viscosity modifiers and dispersion stabilisers may be incorporated in the coating(s) as appropriate. The additives should preferably not increase the overall haze of the receiver sheet above 3.5%, and preferably not above 2.5%.

In particular, the coating medium of the or each coating step, may additionally comprise a minor amount of a surfactant, such as an ethoxylated alkyl phenol, to assist wetting of the coating medium on the surface of the receiving layer and to improve the permeability thereof to dye transferred from the donor sheet.

It is desirable to optimise the general handling characteristics, also known as the slip property, windability or anti-blocking characteristic of the film. The use of the preferred adhesion-promoting medium noted above can achieve this object. However, the or each coating medium may also incorporate a particulate adjuvant, as noted above, to improve the slip property of the receiver sheet. Where there is a plurality of coating steps, however, the particulate adjuvant (or slip agent) is typically present in only one of the coating compositions. Suitably, where there is a plurality of coating steps, the particulate adjuvant is present in the coating composition which comprises the release medium. The adjuvant may comprise any particulate material which does not film-form during film processing subsequent to coating. Suitably, the adjuvant comprises an organic or an inorganic particulate material having an average particle size not exceeding 0.75 μm and being thermally stable at the temperatures encountered during the TTP operation. For example, during the transfer operation, the receiving layer may encounter temperatures of up to about 290° C. for a period of the order of a few milliseconds (ms). Desirably, therefore, the adjuvant is thermally stable on exposure to a temperature of 290° C. for a period of up to 50 ms. Because of the brief exposure time to elevated temperatures the adjuvant may comprise a material having a nominal melting or softening temperature of less than 290° C. For example, the adjuvant may comprise a particulate organic material having a relatively high glass transition temperature, especially a polymeric material such as a polyolefin, polystyrene, polyamide or an acrylic or methacrylic polymer. Polymethylmethacrylate (having a crystalline melting temperature of about 160° C.) is suitable. Preferably, however, the adjuvant comprises an inorganic particulate material such as alumina, titania, silica, china clay or calcium carbonate. A preferred slip agent is silica. The amount of particulate adjuvant will vary depending on the required surface characteristics, and in general will be such that the weight ratio of adjuvant to release medium will be in a range of from 0.25:1 to 2.0:1. Higher adjuvant levels tend to detract from the optical characteristics of the receiver sheet and to inhibit penetration of dye through the release medium, while lower levels are usually inadequate to confer the desired surface frictional behaviour. Preferably, the weight ratio of adjuvant:release medium is in a range of from 0.5:1 to 1.5:1, and especially from 0.75:1 to 1.25:1, for example 1:1. To confer the desired control of surface frictional characteristics the average particle size of the adjuvant should preferably not exceed 0.75 μm. Particles of greater average size also detract from the optical characteristics, such as haze, of the receiver sheet. Desirably, the average particle size of the adjuvant is from 0.001 to 0.5 μm, and preferably from 0.005 to 0.2 μm. It is preferred, however that the desired slip property is achieved via use of the adhesion-promoting medium alone and that a coating layer contains no particulate adjuvant.

Prior to the coating of the receiving layer with the various media described above, particularly the adhesion-promoting medium, the exposed surface of the receiving layer may, if desired, be subjected to a chemical or physical surface-modifying treatment to improve the bond between the receiving layer and the subsequently applied coating. A preferred treatment, because of its simplicity and effectiveness, is to subject the exposed surface of the substrate to a high voltage electrical stress accompanied by corona discharge. Alternatively, the substrate may be pretreated with an agent known in the art to have a solvent or swelling action on the receiving layer polymer. Examples of such agents, which are particularly suitable for the treatment of a polyester-containing receiving layer, substrate, include a halogenated phenol dissolved in a common organic solvent, e.g. a solution of p-chloro-m-cresol, 2,4-dichlorophenol, 2,4,5- or 2,4,6-trichlorophenol or 4-chlororesorcinol in acetone or methanol.

The ratio of receiving layer thickness to coating thickness may vary within a wide range, although the thickness of the coating should preferably not be less than 0.001% nor greater than 10% of that of receiving layer. In practice, for a continuous coat, the thickness of the coating is desirably at least 0.01 μm and preferably should not greatly exceed about 1.0 μm. For a discontinuous coat, the thickness of the coating is less than 0.01 μm.

In a preferred embodiment, the receiver sheet comprises a receiving layer having on both the first and the second surfaces thereof a continuous coating of a cross-linked adhesion-promoting medium as described herein, preferably wherein the cross-linked adhesion promoting medium on the second surface also comprises a phthalate ester. The use of the cross-linked adhesion-promoting medium (preferably comprising a phthalate ester) on the second surface provides a strong bond to the backing sheet to which the receiver sheet will be laminated, particularly when the receiving layer comprises an outer layer of a copolyester as described herein.

In a particularly preferred embodiment, the receiver sheet comprises the following:

(i) a receiving layer having an ABA structure wherein the polymer of the B layer is a clear PET-containing layer and wherein the A layers are clear dye-receptive copolyester-containing layers, particularly wherein the copolyester comprises from 65 to 85 mole % ethylene terephthalate and 35 to 15 mole % ethylene isophthalate;

(ii) a coating on the first surface of the receiving layer comprising an antistatic medium and a release medium and preferably also an adhesion-promoting medium; and (iii) a coating on the second surface of the receiving layer comprising a cross-linked adhesion-promoting medium (which preferably comprises a phthalate ester).

In a further preferred embodiment, the receiver sheet comprises a receiving layer which does not have an adhesion-promoting layer on the second surface thereof. When the receiving layer comprises an outer layer of a heat-sealable polyester, such as the ethylene terephthalate/ethylene isophthalate (82:18) copolyester described herein, it is possible by modulating the thickness of this outer layer to obtain a sufficiently strong adhesion to a backing sheet without the need for the adhesion promoting medium and/or an additional adhesive (as described in more detail below). In this embodiment, the heat-sealable layer should be sufficient to provide a delamination strength (measured as described herein) of at least 6N/cm. When the receiving layer comprises an outer layer of the ethylene terephthalate/ethylene isophthalate (82:18) copolyester described herein, the required delamination strength is suitably achieved by increasing the thickness of this layer to at least about 5 μm and up to about 15 μm. In this embodiment, In this embodiment, the receiver sheet preferably comprises:

(i) a receiving layer having an ABA structure wherein the polymer of the B layer is a clear PET-containing layer and wherein the A layers are clear dye-receptive copolyester-containing layers, particularly wherein the copolyester comprises from 65 to 85 mole % ethylene terephthalate and 35 to 15 mole % ethylene isophthalate; and (ii) a coating on the first surface of the receiving layer comprising an antistatic medium and a release medium and preferably also an adhesion-promoting medium.

The receiver sheet of the present invention is primarily intended for use as an overlaminate or overlay, particularly a clear printable or personalisable overlaminate or overlay for a backing sheet or substrate which carries an image and/or printed information. The receiver sheet exhibits high clarity and is printable. In addition, the receiver sheet exhibits good adhesion to a backing sheet or substrate. The overlay is of particular utility in the manufacture of credit cards, identity cards and the like. A backing sheet or substrate may be pre-printed with, for example, an image and the details of a parent corporation or credit-providing company, while the clear overlay may be printed with the details of, for example, an individual who is a member or employee of the parent corporation or who subscribes to the credit-providing facility. The receiver sheet may also have utility, in association with a suitable adhesive, for the provision of labels.

According to a third aspect of the invention, there is provided the use of a receiver sheet as described herein as a clear printable overlaminate.

According to a fourth aspect of the present invention, there is provided a laminated multilayer film comprising a receiver sheet as described herein and a backing sheet. The backing sheet may carry on one or both surfaces thereof an image and/or printed information. The backing sheet should provide the appropriate rigidity and may be made of any suitable film-forming material, including paper, synthetic paper or a polymeric material. Suitable polymeric materials include polyester, PVC, polyamide, polycarbonate and polyolefin, as described herein. The backing sheet may be monolayer or multilayer. The backing sheet is preferably also printable.

In one embodiment, the backing sheet comprises a printable polyester film, particularly an ink-receptive, opaque copolyesterether-containing film such as that described in EP-A-0 892 721. In an alternative embodiment, the backing sheet is a printable polyethylene terephthalate film.

In a further embodiment, the backing sheet is a heat-sealable film which increases the adhesion between the backing sheet and the receiver sheet(s), and this embodiment is of particular use when the receiver sheet has no adhesion-promoting medium on its second surface and/or when the receiver sheet comprises a heat-sealable polymer on its second surface. For instance, the backing sheet may comprise a multilayer film comprising a substrate (for instance a PET polyester substrate) and one or more outer heat-sealable layer(s) (for instance an ethylene terephthalate/ethylene isophthalate (82:18) copolyester as described herein): Alternatively, the backing sheet may comprise an amorphous copolyester derived from an aliphatic diol and a cycloaliphatic diol, especially ethylene glycol and 1,4-cyclohexanedimethanol, with one or more, preferably one, dicarboxylic acid(s), preferably an aromatic dicarboxylic acid, especially terephthalic acid, particularly wherein the molar ratios of the cycloaliphatic diol to the aliphatic diol are in the range from 10:90 to 60:40, preferably in the range from 20:80 to 40:60, and more preferably from 30:70 to 35:65, and particularly about 33:67.

The laminated multilayer film may be prepared using conventional lamination techniques well-known to the person skilled in the art: the backing sheet is contacted with a receiver sheet, optionally with a layer of adhesive therebetween, and pressure and optionally temperature applied for a given minimum period of time in order to effect the adhesive bond. Any conventional adhesive known in the art may be used, such as an ethyl vinyl acetate (EVA) resin or a polyester urethane resin. The adhesive is preferably applied to the backing sheet, for instance by extrusion coating or hot-melt coating at a thickness of from about 5 to about 25 μm, preferably from about 10 to about 15 μm, and the receiver sheet contacted with the coated backing sheet.

In a preferred embodiment, the laminated multilayer film of the fourth aspect of the invention comprises:

(i) the clear receiver sheet of the first aspect of the invention as described herein, particularly wherein the receiver sheet comprises the preferred ABA receiving layer structure as described herein, optionally with a cross-linked adhesion-promoting medium (preferably containing a phthalate ester) on the second surface thereof;

(ii) a backing sheet (which may be a monolayer or multilayer structure) and;

(iii) the clear receiver sheet of the first aspect of the invention particularly wherein the receiver sheet comprises the preferred ABA receiving layer structure as described herein optionally with a cross-linked adhesion-promoting medium (preferably containing a phthalate ester) on the second surface thereof, wherein the cross-linked adhesion-promoting layers, where present, of receiver sheets (i) and (ii) are disposed such that they are in contact with opposite surfaces of the backing sheet.

The laminated multilayer film may further comprise additional layers, on the whole or a part of the outer surfaces thereof, which additional layers comprise for example signature panels, barcodes, tapes, holograms, security devices etc.

According to a fifth aspect of the invention, there is provided a method of manufacture of a multilayer film comprising forming a receiver sheet as described herein, forming a backing sheet, and laminating said receiving sheet onto one or both surfaces of said backing sheet.

The invention is illustrated by reference to the accompanying drawings in which:

FIG. 1 is a schematic elevation (not to scale) of a receiver sheet (R). Layer (1) comprises the anti-static medium and the release medium and, optionally, the adhesion-promoting medium. The receiving layer (2) comprises a substrate (4) and two dye-receptive layers (3). Layer (5) is an adhesion primer layer comprising a cross-linked adhesion promoting medium.

Figure 2:
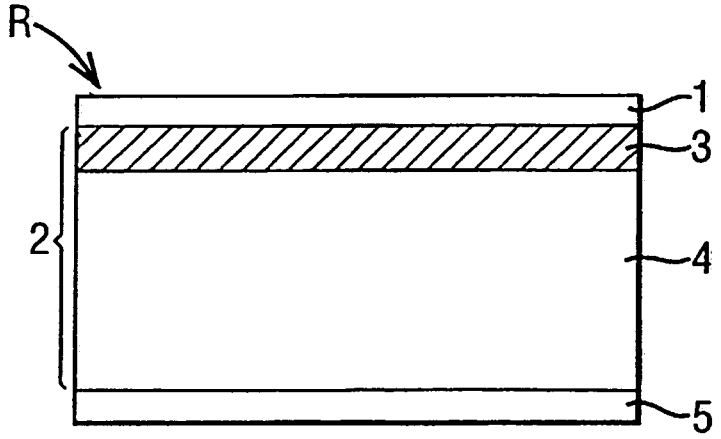

FIG. 2 describes a similar arrangement to FIG. 1, except that the receiving layer (2) is an AB structure comprising a dye-receptive layer (3) and a substrate (4).

Figure 3:
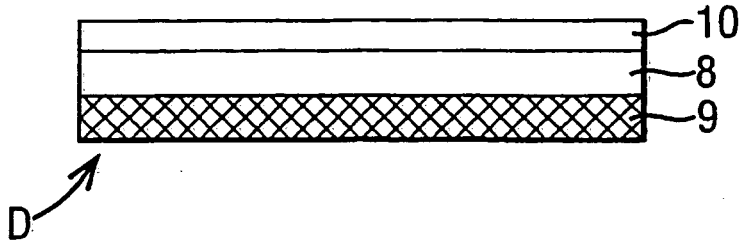

FIG. 3 describes a thermal transfer printing donor sheet (D), comprising a polymeric film substrate (8) (of up to about 10 microns thick), having on one surface thereof a transfer layer (9) comprising a sublimable dye in a resin binder, and on the second surface thereof a polymeric protective layer (10).

Figure 4:
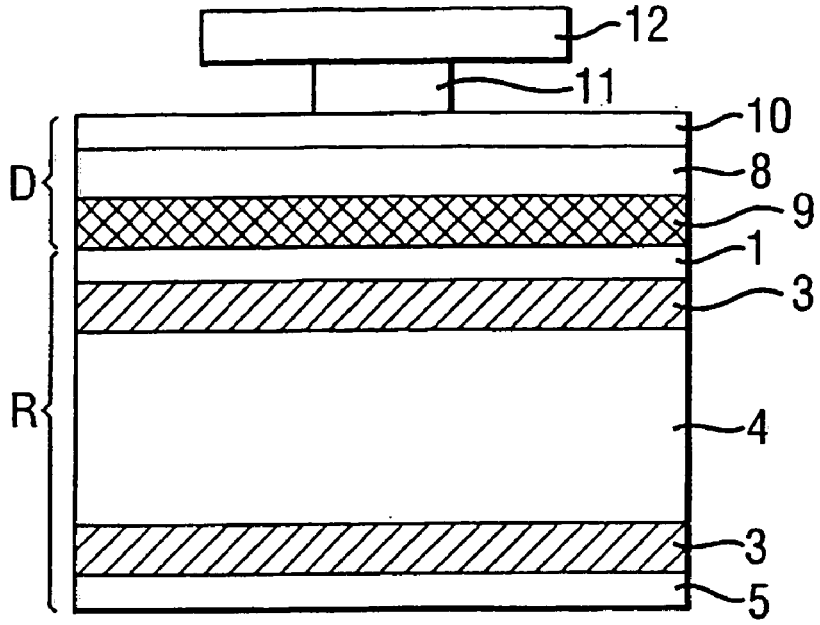
Figure 5:
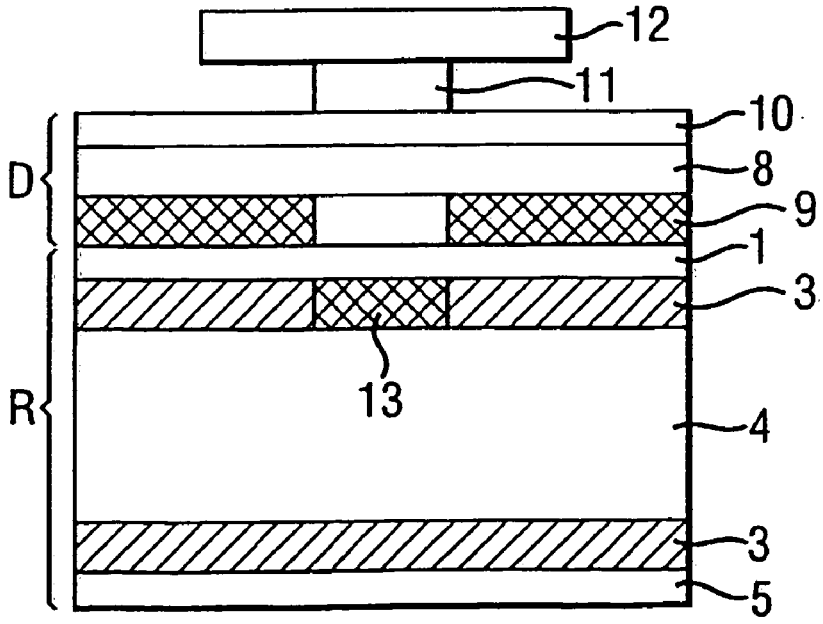

FIG. 4 and FIG. 5 illustrate a TTP process which is effected by assembling a donor sheet and a receiver sheet with the respective transfer layer (9) and the release medium-containing layer (1) in contact. An electrically-activated thermal print-head (12) comprising a plurality of print elements (11) (only one of which is shown) is then placed in contact with the protective layer of the donor sheet. Energisation of the print-head causes selected individual print-elements (11) to become hot, thereby causing dye from the underlying region of the transfer layer to sublime through dye-permeable release layer (1) and into dye-receptive layer (3) where it forms an image of the heated element(s). The resultant imaged receiver sheet is illustrated in FIG. 5 of the drawings. FIG. 5 shows the position after printing when colour has been removed from the donor sheet transfer layer (9) and transferred into the dye-receptive layer (3) at position (13). By advancing the donor sheet relative to the receiver sheet, and repeating the process, a multi-colour image of the desired form may be generated in the receiving layer.

Figure 6:
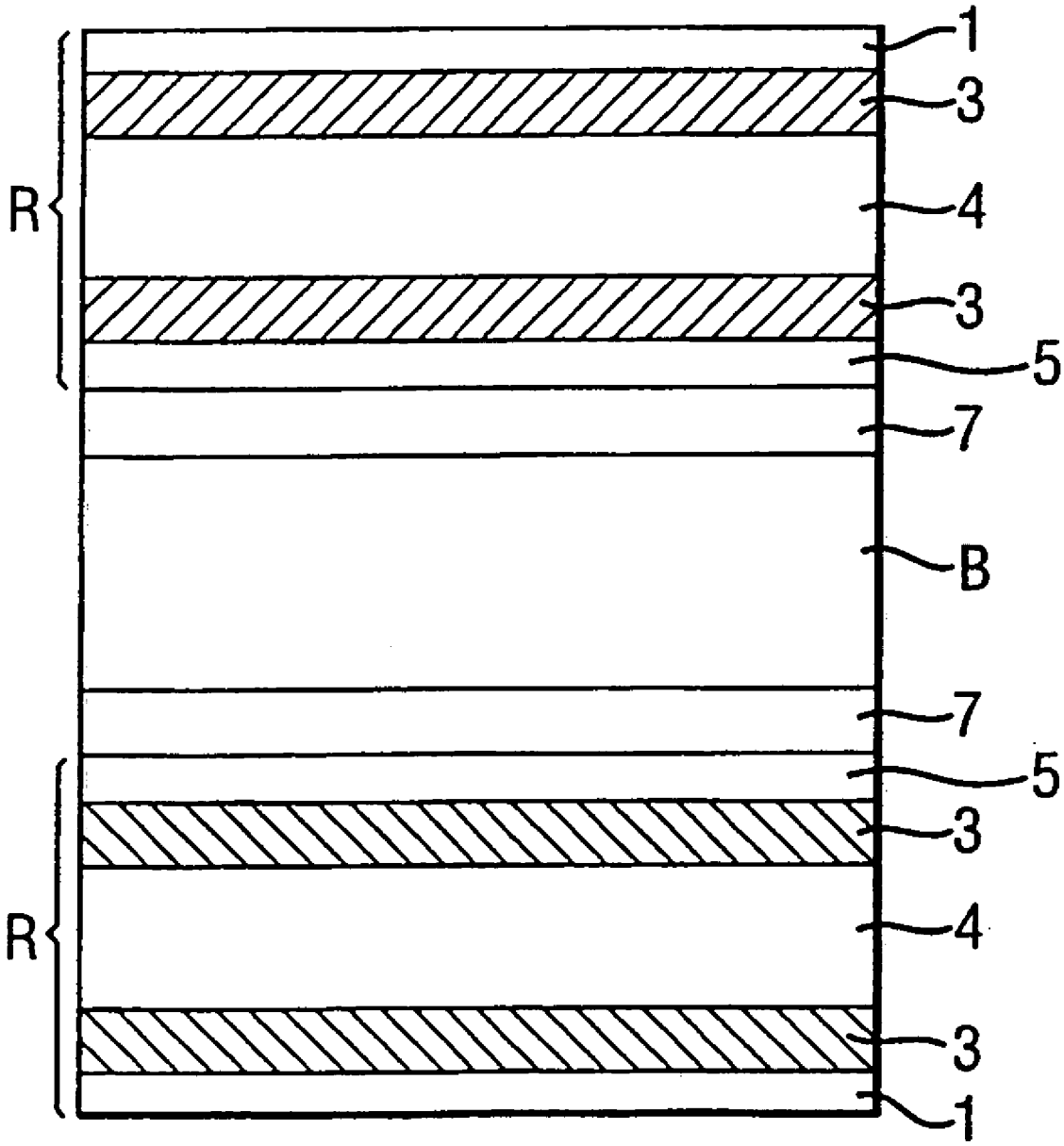

FIG. 6 illustrates (not to scale) the structure of a typical laminated card. Two receiver sheets (R) are disposed about a backing sheet (B) with a layer of adhesive (7) on each surface of the backing sheet.

When completed the laminated card may be used with one receiver sheet printed through layer (1) with TIP information such as a bar code, text or image. The second receiver sheet in the laminated card may be the same as the first and may have applied thereto, for example, a signature panel or magnetic stripe.

Properties of the film are measured as follows:

(i) the clarity of the film is determined by measuring total luminance transmission (TLT) and haze (% of scattered transmitted visible light) through the total thickness of the film using a Gardner XL 211 hazemeter in accordance with ASTM D-1003-61.

(ii) delamination strength is determined by measuring the force required to pull the overlay from the backing sheet in accordance with the European standard test method EN ISO/IEC 10373:1995. It is desirable that the delamination strength is at least 6N/cm.

(iii) surface resistivity is measured using BS2782 (Method 231a; Surface Resistivity; 1991; measuring potential: 500 volts);

(iv) dust contamination (surface dust and dust entrapment) and surface defects were assessed by visual observation, and each sample scored as 1 (low), 2 (medium) or 3 (high) in terms of dust contamination and surface defects;

(v) image quality of the printed cards was assessed using thermal transfer printing comprising multilayer colour image formation, followed by visual observation of intensity and clarity of images and colours, particularly with regard to the correct overlapping of colours.

The invention is further illustrated by reference to the following Examples.

EXAMPLES

Example 1

To prepare a receiver sheet, separate streams of a first polymer comprising polyethylene terephthalate (PET) and a second polymer comprising an unfilled copolyester of 82 mole % ethylene terephthalate and 18 mole % ethylene isophthalate were supplied from separate extruders to a multiple channel coextrusion assembly, and extruded through a film-forming die onto a water-cooled rotating, quenching drum to yield an amorphous cast composite extrudate having an ABA structure wherein the A layers comprise the copolyester of ethylene terephthalate/ethylene isophthalate and the B layer comprises the PET. The cast extrudate was heated to a temperature of about 80° C. and then stretched longitudinally at a forward draw ratio of 3.2:1.

A first surface of the optically-clear receiving layer was coated with a first aqueous coating medium comprising:

(a) AC201® acrylic resin adhesion-promoting medium (Rohm & Haas, Philadelphia, USA) (17% w/w aqueous latex of methyl methacrylate/ethyl acrylate/methacrylamide (46/46/8 mole %) with 25% by weight methoxylated melamine formaldehyde) 5308 ml;

(b) Synperonic NP10® (Uniqema, United Kingdom) surfactant (10% w/w aqueous solution of a nonyl phenol ethoxylate) 150 ml;

(c) Ammonium nitrate (10% w/w aqueous solution) 125 ml;

(d) Permuthane UE41-222a® release medium (Permuthane Coatings, Mass., USA) (30% w/w aqueous polycarbonate-silicone-urethane resin) 2500 ml;

(e) Versa TL-TROY® anti-static medium (National Starch, Daventry, England) (10% w/w aqueous sulphonated styrene-maleic anhydride) 2250 ml; and (f) Demineralised water in an amount to make up the coating medium composition to 50 liters.

The second surface of the optically-clear receiving layer was coated with a second aqueous coating medium comprising:

(a) AC201® acrylic resin adhesion-promoting medium (17% w/w aqueous latex of methyl methacrylate/ethyl acrylate/methacrylamide (46/46/8 mole %) with 25% by weight methoxylated melamine formaldehyde) 9400 ml;

(b) Cymel 385® (Cytec, Netherlands) cross-linking agent (10% w/w aqueous solution of methoxymethyl methylol melamine) 4700 ml;

(c) Santicizer 261® (benzyl-2-ethylhexyl phthalate; Monsanto) (2% w/w aqueous micro emulsion) 1000 ml;

(d) Ammonium nitrate (20% w/w aqueous solution) 60 ml; and (e) Demineralised water in an amount to make up the coating medium to 50 liters.

The longitudinally-stretched coated film was then heated to a temperature of about 96° C. and stretched transversely in a stenter oven at a draw ratio of 4.0:1. The stretched film was finally heat-set under dimensional restraint in a stenter oven at a temperature of about 225° C.

The resultant receiver sheet comprises a biaxially-oriented receiving layer and a coating layer on each side thereof. The receiving layer is multilayer and comprises a substrate layer of unfilled polyethylene terephthalate of about 78 μm thickness having on each surface thereof an essentially amorphous dye-receptive layer of isophthalate-terephthalate copolymer of about 6 μm thickness. On a first surface of the receiving layer is a continuous coating of about 50 nm thickness comprising a release medium, an antistat medium and an adhesion-promoting medium. On a second surface of the receiving layer is a continuous coating of about 50 nm thickness comprising a cross-linked adhesion-promoting medium.

The haze was 2.0%, and TLT was 92.0%. The first surface of the receiver sheet containing the adhesion-promoting, release and antistatic media had a surface resistivity of about 12.0 logohms/square at 50% relative humidity and 23° C.

The receiver sheet was used as an overlay to prepare a laminated card. Two separate receiver sheets were laminated to either side of a backing sheet using an adhesive such that the second surface of each receiver sheet was contacted with the adhesive/backing sheet. The backing sheet was an opaque PET film (containing $TiO_2$ at a level of 13.5% by wt). The adhesive was a poly-1,4-butylene adipate polyester urethane (comprising hexamethylene diisocyanate) applied to the backing sheet by extrusion coating to give a coat thickness of 8–10 μm. The lamination was effected by inserting the receiver-sheet/backing-sheet/receiver-sheet sandwich into a press, heating at 150° C. for 20 minutes under a pressure of 150 lbs/sq. inch, cooling under pressure for a further 20 minutes and then removing. Individual cards of dimensions 85.5 mm by 54.0 mm were then punched out of the laminated sheets.

Printer feedability was excellent, individual cards being easily fed sequentially from a stack, without disruption, to the print head of a thermal transfer printer. The delamination peel strength i.e. the force required to pull the receiver sheet (overlay) from the backing sheet, measured as described herein, was 8.0N/cm.

Example 2

The procedure of Example 1 was repeated except that the second surface of the receiving layer was coated with an aqueous coating medium comprising:

(a) Cyastat SP35® (Cytec, Netherlands) anti-static medium (33% w/w aqueous solution of a quaternary ammonium compound in isopropanol) 1200 ml (b) Rhoplex HA16® (Rohm & Haas) acrylic resin (46% w/w aqueous acrylic emulsion) 620 ml (c) Ammonium nitrate (10% w/w aqueous solution) 130 ml (d) Demineralised water in an amount to make the coating medium up to 50 liters.

The delamination peel strength of a laminated card made from this receiver sheet, as per the method described for Example 1, was 5.0N/cm.

Example 3

A receiving layer was manufactured using a coextrusion procedure similar to that described in Example 1 except that the receiving layer comprised a substrate layer of PET and only one dye-receptive copolyester layer. The surface of the dye-receptive layer was coated with a first coating medium as described in Example 1. The substrate layer was coating with the second coating medium as described in Example 1. A laminated card was made using this receiver sheet, in the manner described in Example 1. The delamination peel strength of a card made from this receiver sheet/overlay, as shown in FIG. 2, was 6.0 N/cm.

Example 4

The procedure of Example 1 was repeated except that the second surface of the receiving layer was not coated. In addition, the thickness of the "A" layers of the ABA composite films, i.e. the layers which comprise the copolyester of ethylene terephthalate and ethylene isophthalate (82:18), were increased to 12.5 μm.

The coated films were then processed and made into a laminated card according to the procedure of example 1, except that an additional adhesive was not used to fix the receiver sheet to the backing sheet. Instead, the receiver sheet was heat-sealed to the backing sheet using the heat-sealable properties of the ethylene terephthalate/ethylene isophthalate copolyester which forms the second (uncoated) surface of the receiver sheet. The backing sheet was a co-extruded opaque PET film having on each surface a 12.5 μm layer comprising a copolyester of ethylene terephthalate/ethylene isophthalate (82:18). The delamination peel force was 7.5 N/cm Examples 5, 6, 7 and 8

These examples were performed to determine the effect of the anti-static component. The coating in these examples comprised varying amounts of the anti-static component. The procedure of Example 1 was repeated except that the first surface of the receiving layer was coated with an aqueous coating medium comprising:

(a) AC201® acrylic resin adhesion-promoting medium (Rohm & Haas, Philadelphia, USA) (17% w/w aqueous latex of methyl methacrylate/ethyl acrylate/methacrylamide (46/46/8 mole %) with 25% by weight methoxylated melamine formaldehyde) 196 ml;

(b) Synperonic NP10® (Uniqema, United Kingdom) surfactant (10% w/w aqueous solution of a nonyl phenol ethoxylate) 15 ml;

(c) Ammonium nitrate (10% w/w aqueous solution) 12.5 ml;

(d) Permuthane UE41-222a® release medium (Permuthane Coatings, Mass., USA) (30% w/w aqueous polycarbonate-silicone-urethane resin) 200 ml;

(e) Versa TL-TROY® anti-static medium (National Starch, Daventry, England) (10% w/w aqueous sulphonated styrene-maleic anhydride) in amounts of 0 ml (example 5), 76 ml (example 6), 228 ml (example 7) and 457 ml (example 8); and (f) Demineralised water (4308 ml, 4232 ml, 4080 ml and 3851 ml, respectively in examples 5, 6, 7 and 8).

The coated films were then processed and made into a laminated card according to the procedure of example 1. The cards were then inspected for surface dust, dust entrapment and surface defects, as described herein. The cards were then printed using conventional thermal transfer printing techniques and evaluated as before. In addition, the image quality of the printed cards was also evaluated. The cards having a receiver sheet coating comprising the anti-static component were superior to those without this component.

The invention claimed is:

1. A thermal transfer printing receiver sheet for use in association with a compatible donor sheet, the receiver sheet having a first and a second surface, the receiver sheet comprising:

a receiving layer to receive a dye thermally transferred from the associated compatible donor sheet, and further comprising a release medium, an adhesion-promoting medium and an antistatic medium, wherein said release medium, said adhesion-promoting medium and said anti-static medium are, independently, present as a coating on at least part of at least one surface of the receiving layer or present in the receiving layer, wherein said receiving layer has an ABA multilayer structure comprising a substrate layer comprising polyethylene terephthalate, wherein said substrate layer is disposed between first and second dye-receptive layers, said dye receptive layers comprising a copolyester of from 65 to 85 mole % ethylene terephthalate and from 35 to 15 mol % ethylene isophthalate and wherein the adhesion-promoting medium on the second surface of the receiver sheet comprises a phthalate ester.

2. The receiver sheet according to claim 1 wherein said receiver sheet is an optically clear receiver sheet having a haze less than 3.5%.

3. The receiver sheet according to claim 1 wherein said release medium, said adhesion-promoting medium and said anti-static medium are, independently, present as a coating on at least part of at least one surface of the receiving layer.

4. The receiver sheet according to claim 1 wherein the receiver sheet comprises a release medium, an anti-static medium and optionally an adhesion-promoting medium on its first surface.

5. The receiver sheet according to claim 1 wherein the receiver sheet comprises a release medium, an anti-static medium and optionally an adhesion-promoting medium on its first surface and an adhesion-promoting medium on its second surface.

6. The receiver sheet according to claim 1 wherein the anti-static medium is anionic or neutral.

7. The receiver sheet according to claim 1 wherein the antistatic medium comprises homopolymer(s) and/or copolymer(s) of sodium styrenesulphonate.

8. The receiver sheet according to claim 1 wherein the anti-static medium comprises poly(sodium styrene sulphonate-maleic anhydride).

9. The receiver sheet according to claim 1 wherein the release medium is a polyurethane resin which is the reaction product of (i) an organic polyisocyanate, (ii) an isocyanate-reactive polydialkylsiloxane, and (iii) a polymeric polyol.

10. The receiver sheet according to claim 1 wherein the adhesion-promoting medium comprises an acrylic and/or methacrylic polymeric resin.

11. The receiver sheet according to claim 1 wherein the adhesion-promoting medium comprises ethyl acrylate and methyl methacrylate.

12. The receiver sheet according to claim 1 wherein the adhesion-promoting medium comprises a cross-liking agent.

13. The receiver sheet according to claim 1 wherein the first surface of the receiver sheet comprises the release medium in an amount of about 0.5 to about 3% by weight; the anti-static medium in an amount of about 0.1 to about 1.0% by weight; and the adhesion-promoting medium in an amount of about 1 to about 4% by weight, relative to the total weight of the dry solids in the coating.

14. The receiver sheet according to claim 1 wherein said at least one surface of the receiving layer is a first surface and wherein a second surface of the receiver sheet comprises the adhesion-promoting medium in an amount of about 2 to about 4% by weight, relative to the total weight of the dry solids in the coating.

15. A clear printable overlaminate, comprising:

the receiver sheet according to claim 1.

16. A laminated multilayer film, comprising:

one or more receiver sheet(s) according to claim 1 and a backing sheet comprising a film-forming material.

17. A laminated multilayer film, comprising:

a first and a second receiver sheet according to the receiver sheet of claim 1 and a backing sheet wherein the phthalate ester-containing layers of said first and second receiver sheets are disposed such that they are in contact with opposite surfaces of the backing sheet.

18. A thermal transfer printing receiver sheet for use in association with a compatible donor sheet the receiver sheet comprising a receiving layer to receive a dye thermally transferred from the associated compatible donor sheet, and further comprising a release medium, an adhesion-promoting medium and an antistatic medium, said release medium, said adhesion-promoting medium and said anti-static medium being independently present as a coating on at least part of at least one surface of the receiving layer or present in the receiving layer, wherein:

(i) said receiving layer has an ABA structure wherein the B layer is a clear PET-containing substrate layer and the A layers are clear dye-receptive layers comprising a copolyester of 65 to mole 85 ethylene terephthalate and 35 to 15 mole % ethylene isophthalate;

(ii) a coating on a first surface of the receiving layer comprises an antistatic medium, a release medium, optionally an adhesion-promoting medium and optionally a cross-linking agent; and (iii) a coating on a second surface of the receiving layer comprises an adhesion-promoting medium, a cross-linking agent and a phthalate ester.

19. A clear printable overlaminate, comprising:

the receiver sheet according to claim 18.

20. A laminated multilayer film, comprising:

one or more receiver sheet(s) according to claim 18 and a backing sheet comprising a film-forming material.

21. A laminated multilayer film, comprising:

a first and a second receiver sheet according to the receiver sheet of claim 18 and a backing sheet wherein the phthalate ester-containing layers of said first and second receiver sheets are disposed such that they are in contact with opposite surfaces of the backing sheet.

* * * * *

UNITED STATES PATENT AND TRADEMARK OFFICE

CERTIFICATE OF CORRECTION

PATENT NO. : 7,101,825 B2
APPLICATION NO. : 10/473704
DATED : September 5, 2006
INVENTOR(S) : John Francis and Andrew Nathan Hodgson It is certified that error appears in the above-identified patent and that said Letters Patent is hereby corrected as shown below:

Col. 26, line 49, delete the word "cross-liking" and insert the word --cross-linking--

Signed and Sealed this

Ninth Day of January, 2007

JON W. DUDAS
*Director of the United States Patent and Trademark Office*